US008147748B2

(12) United States Patent
Nazmy et al.

(10) Patent No.: US 8,147,748 B2
(45) Date of Patent: Apr. 3, 2012

(54) CREEP-RESISTANT STEEL

(75) Inventors: Mohamed Nazmy, Fislisbach (CH); Markus Staubli, Dottikon (CH); Andreas Kuenzler, Baden (CH)

(73) Assignee: ALSTOM Technology Ltd., Baden (CH)

( * ) Notice: Subject to any disclaimer, the term of this patent is extended or adjusted under 35 U.S.C. 154(b) by 105 days.

(21) Appl. No.: 12/565,051

(22) Filed: Sep. 23, 2009

(65) Prior Publication Data

US 2010/0040502 A1 Feb. 18, 2010

Related U.S. Application Data

(63) Continuation of application No. PCT/EP2008/053004, filed on Mar. 13, 2008.

(30) Foreign Application Priority Data

Mar. 29, 2007 (CH) ..... 0506/07

(51) Int. Cl.
*C22C 38/44* (2006.01)
*C22C 38/24* (2006.01)
*C22C 38/26* (2006.01)

(52) U.S. Cl. ..... 420/40; 420/64; 420/69; 148/325

(58) Field of Classification Search ..... 420/40, 420/53, 64, 69; 148/325
See application file for complete search history.

(56) References Cited

U.S. PATENT DOCUMENTS 5,820,817 A 10/1998 Angeliu et al.

(Continued)

FOREIGN PATENT DOCUMENTS

CN 88100065 10/1988
CN 1451778 10/2003

(Continued)

OTHER PUBLICATIONS

Kauffman, F., et al., "Microstructural Investigation of the Boron containing TAF Steel and the Correlation to the Creep Strength," 31. MPA-Seminar in Verbindung mit der Fachtagung, "Werstoff- & Bauteilverhalten in der Energie- & Anlagdentechnik," 13. und 14. Oct. 2005, Stuttgart, Germany, pp. 27.1-27.18.

(Continued)

*Primary Examiner* — Deborah Yee
(74) *Attorney, Agent, or Firm* — Cermak Nakajima LLP; Adam J. Cermak

(57) ABSTRACT

A creep-resistant steel is characterized by the following chemical composition (values in % by weight): 9.0 to 12.0 Cr, 0.1 to 0.5 Mn, 2.3 to 3 Ni, 1.5 to 2.0 Mo, 0.1 to 0.4 V, 0.01 to 0.06 Nb, 0.08 to 0.16 C, 0.02 to 0.08 N, 0.004 to 0.012 B, 0.001 to 2 Ta, 0.001 to 0.5 La, 0.0001 to 1 Pd, maximum 0.005 P, maximum 0.005 S, maximum 0.05 Si, maximum 0.005 Sn, the remainder iron and unavoidable impurities. This steel is distinguished, as compared with commercial steels, by a greatly improved creep behavior at temperatures of 550° C. and above. Moreover, it has an improved resistance to embrittlement during long-term aging and comparatively high toughness. The steel is advantageously used as a material for gas turbine rotors which are exposed to high inlet temperatures in order to increase the efficiency of the gas turbine, but is also used for steam turbines.

24 Claims, 4 Drawing Sheets

U.S. PATENT DOCUMENTS

| | | | | |
|---|---|---|---|---|
| 5,906,791 | A * | 5/1999 | Angeliu | 420/40 |
| 6,299,704 | B1 * | 10/2001 | Igarashi et al. | 148/325 |
| 2002/0020473 | A1 | 2/2002 | Sawaragi et al. | |

FOREIGN PATENT DOCUMENTS

| | | |
|---|---|---|
| DE | 3426882 | 4/1985 |
| DE | 19832430 | 2/1999 |
| EP | 0866145 | 9/1998 |
| EP | 0867522 | 9/1998 |
| EP | 0931845 | 7/1999 |
| EP | 1158067 | 11/2001 |
| WO | WO94/08063 | 4/1994 |
| WO | WO2006/045708 | 5/2006 |
| WO | WO2008/119638 | 10/2008 |

OTHER PUBLICATIONS

Kern, T.-U., et al., "High Temperature Forged Components for Advanced Steam Power Plants," in Materialsfor Advanced Power Engineering 1998, pp. 53-61, Proceedings of the 6th Liege Conference, ed. by J. Lecomte-Becker et al.

Lula, R.A., et al., "Residual and Minor Elements in Stainless Steels," Handbook of Stainless Steels 1977, pp. 14-1-14-14, Carnegie-Mellon University, Pittsburgh, PA, US, XP002430954.

Search Report for Swiss Patent App. No. 0506/2007 (May 3, 2007).

International Search Report for PCT Patent App. No. PCT/EP2008/053004 (Jun. 20, 2008).

* cited by examiner

CREEP-RESISTANT STEEL

This application is a Continuation of, and claims priority under 35 U.S.C. §120 to, International application no. PCT/EP2008/053004, filed 13 Mar. 2008, and claims priority therethrough under 35 U.S.C. §§119, 365 to Swiss application no. 00506/07, filed 29 Mar. 2007, the entireties of which are incorporated by reference herein.

BACKGROUND

Field of Endeavor

The invention relates to steels based on 9-12% chromium which are used for rotors in the power station sector. It relates to the selection and the co-ordination, in terms of quantity fractions, of special alloying elements which make it possible to set an unusually high creep resistance, at temperatures of 550° C. and above, in this material. The steel according to the invention is also to have high toughness after long-term aging, so that it can be used both in gas turbines and in steam turbines.

BRIEF DESCRIPTION OF THE RELATED ART

Martensitically hardenable steel based on 9-12% chromium are materials in widespread use in power station technology. They were developed for application in steam power stations at operating temperatures of above 600° C. and steam pressures of above 250 bar, in order to increase the efficiency of the power stations. Under these operating conditions, the creep resistance and the oxidation resistance of the material play a particular part.

It is known that the addition of chromium in the abovementioned range not only allows high resistance to atmospheric corrosion, but also makes it possible to have the full hardenability of thick-walled forgings, such as are employed, for example, as monobloc rotors or as rotor disks in gas and steam turbines. Proven alloys of this type usually contain about 0.08 to 0.2% carbon which, in solution, makes it possible to set a hard martensitic structure. A good combination of heat resistance and ductility of martensitic steels is made possible by an annealing treatment in which a particle-stabilized subgranular structure is formed as a result of the precipitation of carbon in the form of carbides, while at the same time the dislocation substructure is recovered. The annealing behavior and the properties resulting from this can be influenced effectively by the choice and the co-ordination, in terms of quantity fractions, of special carbide formers, such as, for example, Mo, W, V, Nb, and Ta.

A typical representative which has been in widespread use in steam power stations, in particular as rotor steel, is the German steel known under DIN as X20CrMoV12.1.

It is known, furthermore, that ductility can be markedly improved at a strength level of 850 MPa by alloying with nickel. Such alloys are therefore in widespread use where both strength and ductility have to meet markedly higher requirements, typically as disk materials for gas turbine rotors. A typical representative of such alloys which has been in widespread use in gas turbine technology, in particular as material for rotor disks, is the German steel known under DIN as X12CrNiMo12. However, the tendency is for nickel to have the adverse effect of lowering the heat resistance at high temperatures. This is related to reduced carbide stability in nickel-containing steels.

In the past, various efforts have been made to improve special properties of the known 9-12% Cr steels. Thus, for example, the publication of Kern et al: High Temperature Forged Components for Advanced Steam Power Plants, in Materials for Advanced Power Engineering 1998, Proceedings of the 6th Liège Conference, ed. by J. Lecomte-Becker et al., describes the development of novel rotor steels for steam turbine applications.

In such alloys, the contents of Cr, Mo, and W were optimized, taking into account N, Nb, and/or B, in order to improve the creep and rupture strengths for applications at 600° C. The carbides, such as, for example, $M_{23}C_6$, are to be stabilized by the addition of boron. On account of the harmful effect of nickel on the long-term properties, in these steels the Ni contents were restricted to values of lower than 0.25%. In these alloys, the disadvantage is that the fracture toughness values are low, and, although this does not play an important part in steam turbine applications and may therefore be ignored, it must be avoided in gas turbine applications.

In later publications (F. Kauffmann et al.: "Microstructural Investigation of Boron containing TAF Steel and the Correlation to the Creep Strength", 31st MPA Seminar in conjunction with the specialist conference "Werkstoff-und Bauteilverhalten in der Energie-und Analagentechnik" ["Material and component behavior in power and plant technology"], 13./14.10.2005, Stuttgart), for this reason the Ni contents were limited even to the values of <0.002% in the case of an addition of B of 0.03% to a 10.5% Cr steel.

Particularly for gas turbine applications, efforts were made, in 9-12% Cr steels, either to improve the rupture strengths in the range of 450 to 500° C. at a high ductility level or to reduce the tendency for embrittlement at temperatures of between 425 and 500° C. Thus, European patent application EP 0 931 845 A1 describes a nickel-containing 12% chromium steel which is similar in constitution to the German steel X12CrNiMo12 and in which the element, molybdenum, was reduced, as compared with the known steel X12CrNiMo12, but an increased content of tungsten was added for alloying. DE 198 32 430 A1 discloses a further optimization of a steel with the designation M152 which is of the same type as X12CrNiMo12 and in which the tendency for embrittlement in the temperature range between 425 and 500° C. is limited by the addition of rare earth elements.

The disadvantage is that the strength, in particular the heat resistance at temperatures of between 300 and 600° C., could not be improved in any of the abovementioned developments at a high ductility level comparable to that of the steel X12CrNiMo12.

One possible approach for improving the heat resistance, while at the same time having high ductility, which was proposed, was the development of steels having increased nitrogen contents. EP 0 866 145 A2 describes a new class of martensitic chromium steels with nitrogen contents in the range between 0.12 and 0.25%, and, in EP 1 158 067 A1, with nitrogen contents of 0.12 to 0.18%, the weight ratio V/N lying in the range between 3.5 and 4.2. In these steels, the entire structural generation is controlled by the formation of special nitrides, in particular of vanadium nitrides, which can be distributed in many different ways by forging treatment, by austenitization, by controlled cooling treatment or by annealing treatment. While strength is achieved via the hardening action of the nitrides, the aim is to set a high ductility by the distribution and morphology of the nitrides, but, above all, by limiting the granular coarsening during forging and during solution heat treatment.

A heat-resistant steel with good toughness properties for use as a turbine rotor is known from EP 0867 522 A2 and has the following chemical composition (% by weight): 0.05-0.30 C, 0.20 or less Si, 0-1.0 Mn, 8-14 Cr, 0.5-3.0 Mo, 0.10-0.50 V, 1.5-5.0 Ni, 0.01-0.5 Nb, 0.01-0.08 N, 0.001-0.020 B, the remainder iron and unavoidable impurities. Microalloying with boron leads to precipitations at the grain boundaries and increases the long-term stability of the carbonitrides at high temperatures, although higher contents of B reduce the toughness of the steel. Disadvantages of this proposed composition are also the relatively high permitted Si values in the amount of 0.2%. Although Si advantageously serves as a deoxidant at the melting time point, on the other hand, parts of this remain as oxides in the steel, and this is reflected adversely in a reduced toughness.

Finally, U.S. Pat. No. 5,820,817 proposes stainless steels with 8-13% by weight Cr, which have, among other things, boron and/or rare earths in their composition in order to increase resistance to embrittlement under long-term ageing. According to this document, the maximum content of rare earths is to amount to 0.5% by weight, an optimal fraction being given as 0.1% by weight.

SUMMARY

One of numerous aspects of the present invention includes a 9-12% Cr steel which is distinguished, as compared with the known prior art, by increased creep resistance at temperatures of 550° C. and above, and which has improved resistance to embrittlement under long-term aging and comparatively high toughness, so that it can be used primarily in gas turbine, but also steam turbine, power plants. It is preferably to be used for rotors of turbomachines, so that the efficiency and output can be increased, as compared with the known prior art.

Another aspect includes a steel having the following chemical composition (values in % by weight): 0.08 to 0.16 C, 9.0 to 12.0 Cr, 0.1 to 0.5 Mn, 2.3 to 3 Ni, 1.5 to 2.0 Mo, 0.1 to 0.4 V, 0.01 to 0.06 Nb, 0.02 to 0.08 N, 0.001 to 2 Ta, 0.001 to 0.5 La, 0.0001 to 1 Pd, 0.004 to 0.012 B, maximum 0.005 P, maximum 0.005 S, maximum 0.05 Si, maximum 0.005 Sn, the remainder iron and unavoidable impurities.

Advantageously, the steel has, according to principles of the present invention, the following chemical composition (values in % by weight): 0.12 C, 11.5 Cr, 0.2 Mn, 2.5 Ni, 1.7 Mo, 0.25 V, 0.03 Nb, 0.04 N, 0.01 Ta, 0.05 La, 0.001 Pd, 0.007 B, 0.005 P, 0.005 S, 0.05 Si, 0.005 Sn, the remainder iron and unavoidable impurities.

One potential advantage is that the alloy has, under the same heat treatment, improved creep properties at temperatures of 550° C. and above, in comparison with alloys of similar composition, which are known from the prior art, but without a B addition or without an La and Pd addition, good toughness properties (elongation, impact work) and improved resistance to embrittlement under long-term aging also being achieved.

A tempered structure is set which is distinguished by a tough basic matrix and by the presence of nitrides, borides and carbides which afford heat resistance. The toughness of the basic matrix is set by the presence of substitution elements, preferably by nickel. The contents of these substitution elements are determined such that they allow an optimal development both of martensitic hardening and of particle hardening due to the precipitation of special nitrides, for example vanadium nitrides or niobium nitrides, for the purpose of setting the highest possible heat resistances.

Basically, both hardening mechanisms lower the ductility. A ductility minimum is in this case characteristically observed in the region of secondary hardening. This ductility minimum need not be caused solely by the actual precipitation hardening mechanism. A certain contribution to embrittlement may also be made by the segregation of impurities up to the grain boundaries or, possibly, also by near-order settings of dissolved alloy atoms.

A rise in the annealing temperature over the secondary hardening range leads to complete precipitation, with a marked growth of carbides. As a result, the strength decreases and the ductility increases. It is essential that ductility increases to a great extent due to the simultaneous recovery of the dislocation substructure and particle coarsening, so that the combination of strength and ductility, overall, is improved. This improvement is attributable to the formation of a particle-stabilized subgranular structure. It is to be assumed, in this case, that both the ductility and the strength of particle-stabilized subgranular structures are reduced by nonuniformities in the topology of the particle subgranular structure. Precipitations at subgranular boundaries are subject to accelerated coarsening and tend to coagulate with adjacent precipitations. Coarse and coagulated phases generate fracture-triggering stress peaks which lower the ductility. Above all, however, the hardening mechanism which is the most effective at high temperatures, to be precise the particle hardening, is seriously limited by the nonuniform distribution of the precipitations.

One measure for increasing the ductility in conventional martensitically hardenable steels is alloying with nickel. The causes of this, however, are not known in all points and would seem to depend greatly on the nickel content. Thus, even small fractions of nickel may be highly conducive to ductility if, for example, the formation of delta ferrite can thereby be suppressed completely. By contrast, with nickel contents of above 2% by weight, it is expected that nickel lowers the Ac1 temperature (this is the temperature at which ferrite begins to be converted into austenite during heating) to temperatures of below 700° C. If, therefore, the strength is to be increased by a lowering of the annealing temperature to below 700° C., then, if increased nickel contents are present, a partial conversion of ferrite into austenite must be reckoned on during annealing. This is associated with a certain ductility-promoting grain reforming. By contrast, however, it must be remembered that the carbide precipitation takes place only incompletely above the Ac1 temperature, since the solubility of the austenite-stabilizing element, carbon, is higher in austenite than in ferrite. Further, the austenite which is formed is not sufficiently stabilized, and therefore a larger volume fraction of the reformed austenite is subjected to further martensitic conversion during recooling after annealing. In addition to the two abovementioned contributions of nickel with the effect of an increase in ductility, a certain contribution to ductility by nickel can be made in its action as a substitution element in solid solution. This can be explained by electron theory in that the element, nickel, feeds additional free electrons into the iron lattice and thereby makes the iron alloys even more "metallic".

Basically, conventional martensitically hardenable steels which are alloyed with nickel do not have any special heat resistance advantages, as compared with low-nickel alloys. This applies, at least, to test temperatures of above 500° C. and, in the case of increased nickel contents, could be connected with the abovementioned reaustenitization during annealing. It is known, furthermore, that the alloying of such steels with nickel markedly intensifies the structural instability under long-term age-hardening conditions at increased temperatures. This long-term structural instability is in this case related to an accelerated coarsening of the carbides.

Manganese lies on the left side next to the element iron, in the periodic system of elements. It is an electron-leaner element, and therefore its action in a solid solution should be markedly different from that of nickel. Nonetheless, it is an austenite-stabilizing element which greatly lowers the Ac1 temperature, and does not have an especially positive, but, instead, a somewhat adverse effect on the ductility. With regard to carbon-containing 12% chromium steels, manganese is understood to be a contaminating element which appreciably promotes annealing embrittlement. The manganese content is therefore usually limited to very small quantities.

The preferred quantities in percentages by weight for each element and the reasons for the selected alloy ranges according to principles of the present invention, in their relation to the heat treatment possibilities resulting from them, are listed below.

Chromium:

A weight fraction of 9-12% chromium allows a good full hardenability of thick-walled components and ensures sufficient oxidation resistance up to a temperature of 550° C. A weight fraction of below 9% is detrimental to full hardening. Contents above 12% lead to the accelerated formation of hexagonal chromium nitrides during the annealing operation, which, in addition to nitrogen, also bind vanadium, and, consequently, lower the effectiveness of hardening by vanadium nitrides. The optimal chromium content is 10.5 to 11.5%.

Manganese and Silicon:

These elements are conducive to annealing embrittlement and must therefore be limited to very small contents. Taking into account the metallurgical possibilities, the range to be specified should lie, for manganese, in the range between 0.1 and 0.5% by weight, preferably between 0.1 and 0.25%, in particular at 0.2% by weight, and, for silicon, at max. 0.05% by weight.

Nickel:

Nickel is used as an austenite-stabilizing element for the suppression of delta ferrite. Furthermore, as a dissolved element in the ferritic matrix, it is to improve ductility. Nickel contents of 2.3 to about 3% by weight are expedient. Nickel contents above 4% by weight intensify the austenite stability in such a way that, after solution heat treatment and annealing, an increased fraction of residual austenite or annealing austenite may be present in the hardened martensite. The nickel content preferably lies at 2.3 to 2.8, in particular at 2.5% by weight.

Molybdenum:

Molybdenum improves the creep resistance by solid solution hardening as a partially dissolved element and by precipitation hardening during long-term stress. However, an excessively high fraction of this element leads to embrittlement during long-term age hardening, which is due to the precipitation and coarsening of the Laves phase (W, Mo) and sigma phase (Mo). The range for Mo is 1.5 to 2% by weight, preferably 1.6 to 1.8% by weight, in particular 1.7% by weight.

Vanadium and Nitrogen:

These two elements together critically control the grain size formation and the precipitation hardening. A slightly above-stoichiometric V/N ratio sometimes also increases the stability of the vanadium nitride with respect to the chromium nitride. The actual content of nitrogen and vanadium nitrides depends on the optimal volume fraction of the vanadium nitrides which are to remain as insoluble primary nitrides during the solution heat treatment. The larger the overall fraction of vanadium and nitrogen is, the larger that fraction of the vanadium nitrides which is no longer dissolved is, and the higher the grain-refining action is. However, the positive influence of grain refinement on ductility is limited, since, with an increasing volume fraction of primary nitrides, the primary nitrides themselves limit the ductility. The preferred nitrogen content lies in the range of 0.02 to 0.08% by weight, preferably 0.025 to 0.055% by weight, particularly preferably at 0.04% by weight N, and the vanadium content lies in the range of between 0.1 and 0.4% by weight, preferably 0.2 to 0.3% by weight, and, in particular, at 0.25% by weight.

Niobium:

Niobium is a strong nitride former which promotes the grain-refining action. In order to keep the volume fraction of primary nitrides low, its overall fraction must be limited to 0.1% by weight. Niobium dissolves in small quantities in vanadium nitride and can consequently improve the stability of the vanadium nitride. Niobium is added for alloying in the range of between 0.01 and 0.06% by weight, preferably 0.02 to 0.04% by weight, and, in particular, at 0.03% by weight.

Phosphorus, Sulfur, Tin:

These elements, together with silicon and manganese, intensify annealing embrittlement during long-term age hardening in the range between 350 and 500° C. These elements should therefore be limited to maximum acceptable fractions (0.005% by weight).

Tantalum:

Ta positively influences the creep resistance. Alloying with 0.001 to 2% by weight Ta has the effect that, because of the greater tendency of tantalum to form carbides than chromium, on the one hand, the precipitation of undesirable chromium carbides at the grain boundaries is diminished and, on the other hand, the undesirable depletion of the chromium mixed crystal is also reduced. The preferred range for Ta is 0.005 to 0.1% by weight, and, in particular, a Ta content of 0.01% by weight should be set.

Carbon:

Carbon, during annealing, forms chromium carbides which are conducive to improved creep resistance. At carbon contents which are too high, however, the increased volume fraction of carbides which results from this leads to a ductility reduction which, in particular, is reflected by carbide coarsening during long-term age hardening. The carbon content should therefore have an upper limit of 0.16% by weight. Another disadvantage is that carbon intensifies hardening during welding. The preferred carbon content lies in the range between 0.10 and 0.14% by weight, preferably at 0.12% by weight.

Boron:

Boron stabilizes the $M_{23}C_6$ precipitations and hence improves the creep resistance of the steel, although the formation of boron nitrides at the expense of the vanadium carbonitrides must be prevented. Moreover, it must be remembered, however, that the austenitization temperature has to be increased in order to obtain homogeneous boron in the matrix, but this, in turn, leads to an increase in the grain size and consequently to poorer properties of the material. The boron content is therefore to be limited to 40 to 95 ppm. A B content of 50 ppm to 90 ppm, particularly preferably of about 70 ppm, is preferably to be set.

Lanthanum:

Lanthanum bonds the sulfur in the steel by the formation of lanthanum sulfide $La_2S_3$. $La_2S_3$ is significantly more stable than $MnS_2$. It has a melting point of >2100° C. whereas $MnS_2$ decomposes at high temperatures with the release of S. However, since certain contents of S are firstly required and secondly are also unavoidable as impurities on account of the steel production process, and sulfur disadvantageously increases the tendency of the material for embrittlement, stable sulfide formers in the steel, such as La, are significantly better than Mn. Moreover, the grain size is advantageously reduced by microalloying with La, and this also has an advantageous effect if the material is tested nondestructively by ultrasound processes. By way of example, the applicant has determined a grain size ASTM 6 in the case of a 12% Cr steel doped with B at an austenitization temperature of 1100° C., whereas the grain size was only ASTM 7 in the case of a 12% Cr steel microalloyed with B and La at the same austenitization temperature. In addition, the weldability of the 12% Cr steels is improved on account of the very high stability of the lanthanum sulfides and the positive effect on the prevention of interdendritic weld cracks. However, since lanthanum disadvantageously also forms oxides, the content of La should lie at 0.001 to 0.5% by weight, preferably at 0.01 to 0.1% by weight, in particular at 0.05% by weight.

Palladium:

Pd forms, with the iron of the steel, an ordered intermetallic Fe—Pd $L1_0$ phase, the α" phase. This stable α" phase increases the rupture strength at high temperatures by the stabilization of the grain boundary precipitations, such as, for example, $M_{23}C_6$, and therefore has a positive effect on the creep properties. However, palladium has the disadvantage of high costs. The Pd content of the proposed steel should lie in the range of 0.0001 to 1, preferably of 0.0005 to 0.01% by weight, a content of 0.001% by weight being particularly suitable.

BRIEF DESCRIPTION OF THE DRAWINGS

An exemplary embodiment of the invention is illustrated in the drawings, in which.

DETAILED DESCRIPTION OF EXEMPLARY EMBODIMENTS

The invention is explained in more detail below with reference to an exemplary embodiment and to FIGS. 1 to 4.

The investigated alloy L2 according to the invention had the following chemical composition (values in % by weight): 0.12 C, 11.5 Cr, 0.2 Mn, 2.5 Ni, 1.7 Mo, 0.25 V, 0.03 Nb, 0.04 N, 0.01 Ta, 0.05 La, 0.001 Pd, 0.0070 B, 0.05 Si, 0.005 P, 0.005 S, 0.005 Sn, the remainder iron and unavoidable impurities.

The comparative alloy VL1 used was a commercial steel of the type X12CrNiMoV11-2-2 which is known from the prior art and has the following chemical composition (values in % by weight): 0.10-0.14 C, 11.0-12.0 Cr, 0.25 Mn, 2.0-2.6 Ni, 1.3-1.8 Mo, 0.2-0.35 V, 0.02-0.05 N, 0.15 Si, 0.026 P and 0.015 S.

The two alloys therefore have a comparable composition, the difference being that the alloy L2 according to the invention is additionally microalloyed with Nb, B, and La and Pd and contains Ta.

The alloy L2 according to the invention and the comparative alloy VL1 were subjected to the following heat treatment processes:

1. Normalizing at 1100° C./3 h/blower air cooling at room temperature
2. Annealing treatment at 640° C./5 h/air cooling at room temperature Samples for determining the mechanical properties were produced from the materials treated in this way. Long-term age hardenings at 450° C., 480° C. and 550° C. were carried out under specific mechanical loads, and the impact energy and fracture toughness at room temperature were determined. The results are illustrated in FIGS. 1 to 4.

Figure 1:
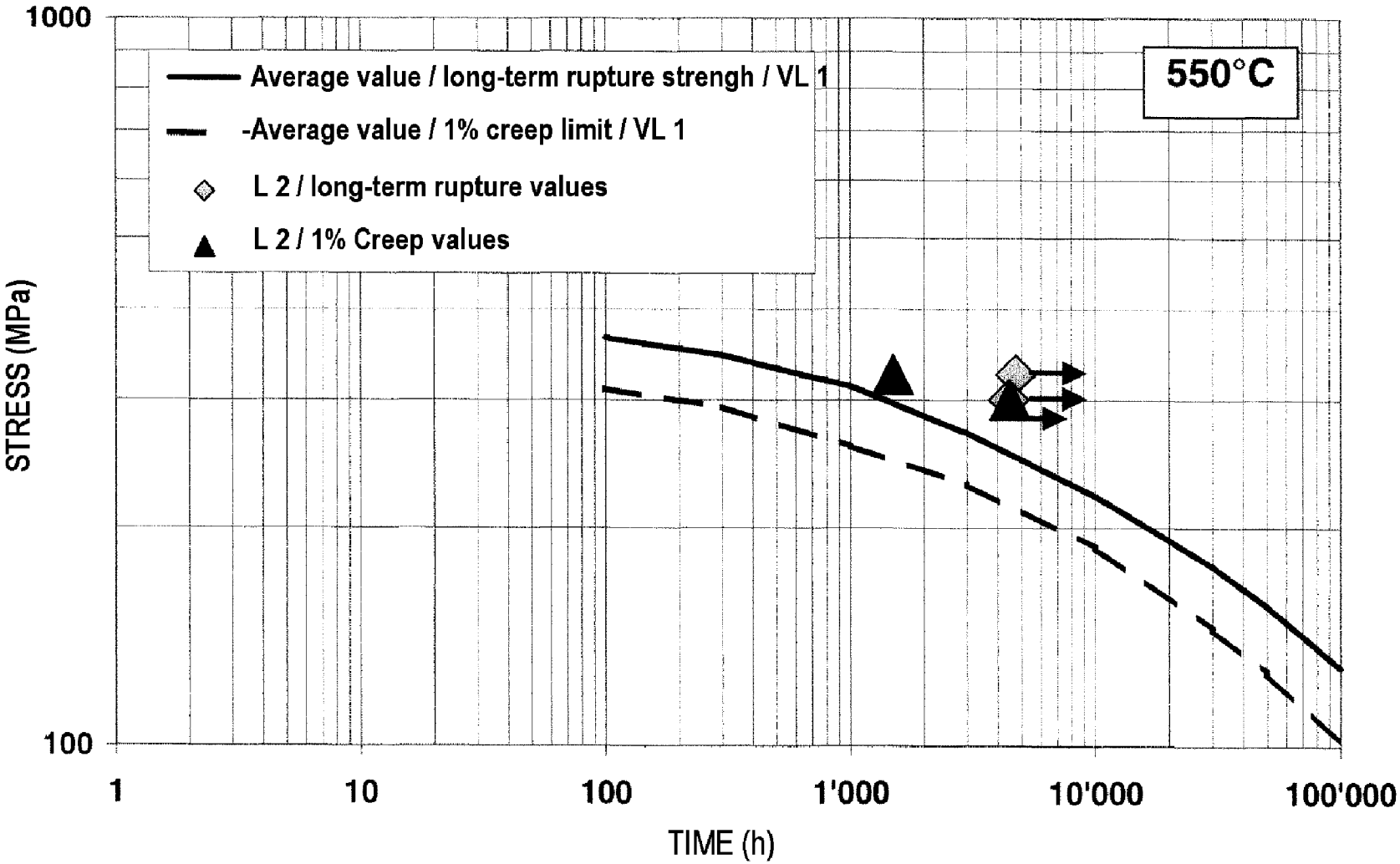
FIG. 1 shows a graphical illustration in which the stresses of selected alloys (VL1 according to the prior art and L2 according to the present invention) are plotted against the average time, at a temperature of 550° C., up to the fracture or up to 1% elongation of the material.

FIG. 1 shows the properties during creeping, that is to say the rupture strength and the 1% elongation limit, at 550° C. for the two alloys VL1 and L2. This graph thus illustrates the average times up to fracture and until a 1% elongation is reached as a function of the stress at 550° C.

It is shown that, at the given temperature, the alloy L2 according to the invention advantageously requires considerably longer times under the action of the same stress until a 1% elongation is reached than the comparative alloy VL1. During the time up to fracture (rupture strength), this difference can be seen even more clearly, since the samples, given an arrow in FIG. 1, of the alloy L2 have not yet even been fractured. Here, in the case of the alloy L2 according to the invention, a marked shift toward longer times can be seen, this being particularly advantageous for the planned use as a gas turbine rotor or steam turbine rotor.

Figure 2:
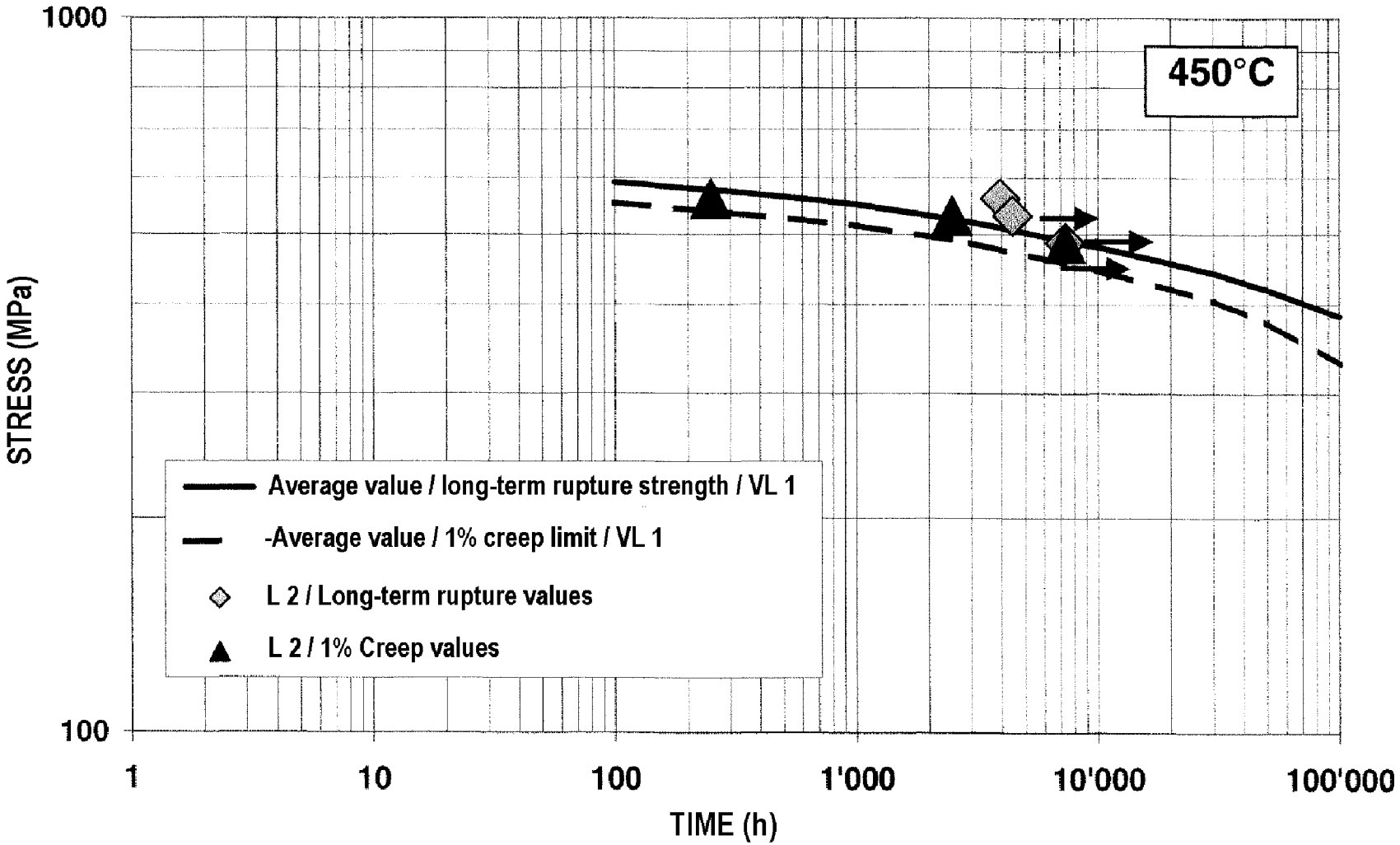
FIG. 2 shows a graphical illustration analogous to FIG. 1, but at a temperature of 450° C.

FIG. 2 shows the same relationships, but for a lower temperature (450° C.). Although the differences between the behavior of the comparative alloy VL1 and the alloy L2 according to the invention can also be seen in this figure, these are not as serious as the results shown in FIG. 1.

Figure 3:
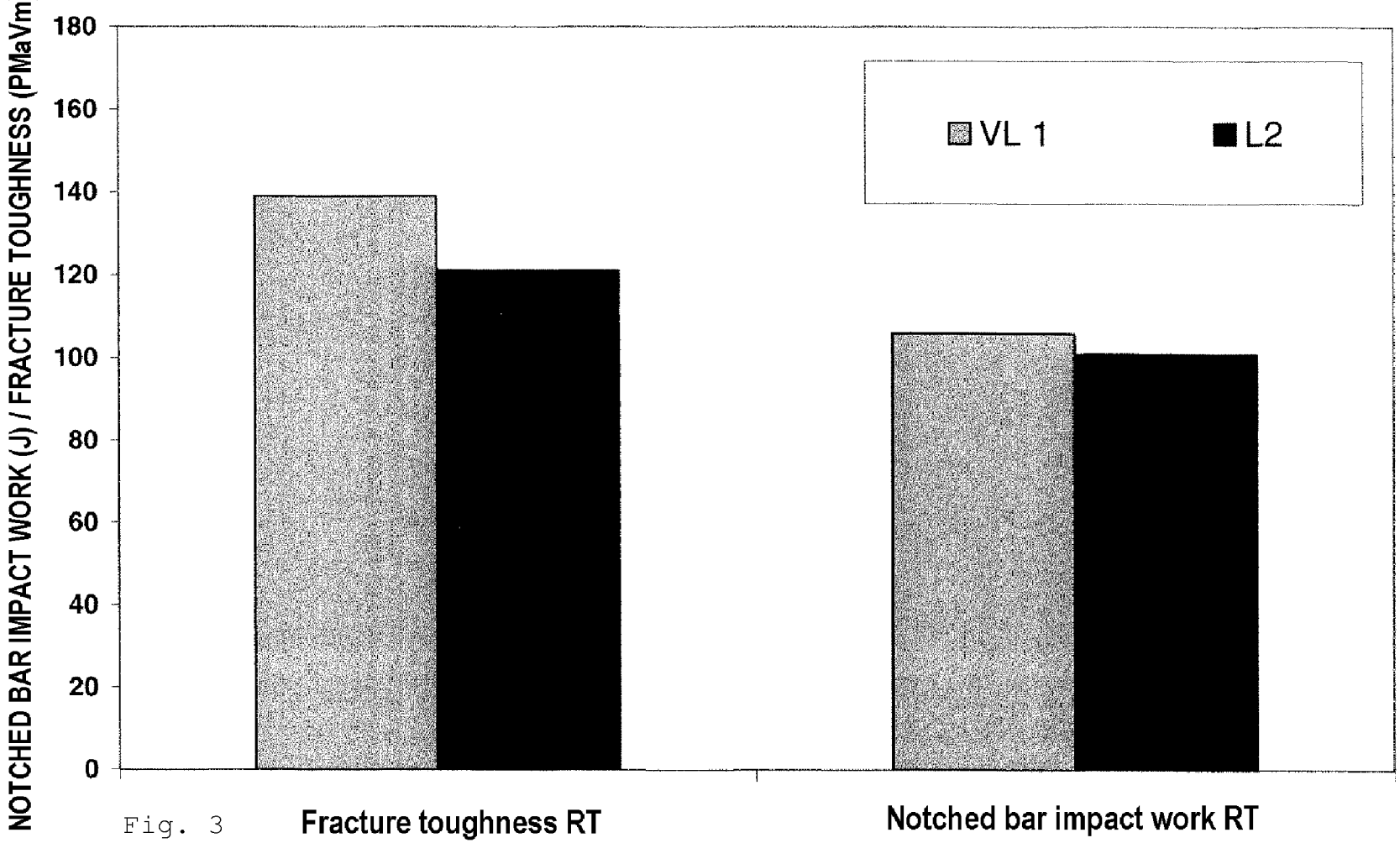
FIG. 3 shows a graphical illustration in which the fracture toughness (left part image) and the impact energy (right part image) are compared for the two alloys VL1 and L2 at room temperature in the heat-treated state (without age hardening)

In FIG. 3, the fracture toughnesses and the impact energies at room temperature are compared for the two alloys investigated, in the above-described heat treatment state (without age hardening). In spite of the markedly better creep properties at high temperatures (see FIGS. 1 and 2), in the alloy according to the invention there is scarcely any impairment in the toughness.

Figure 4:
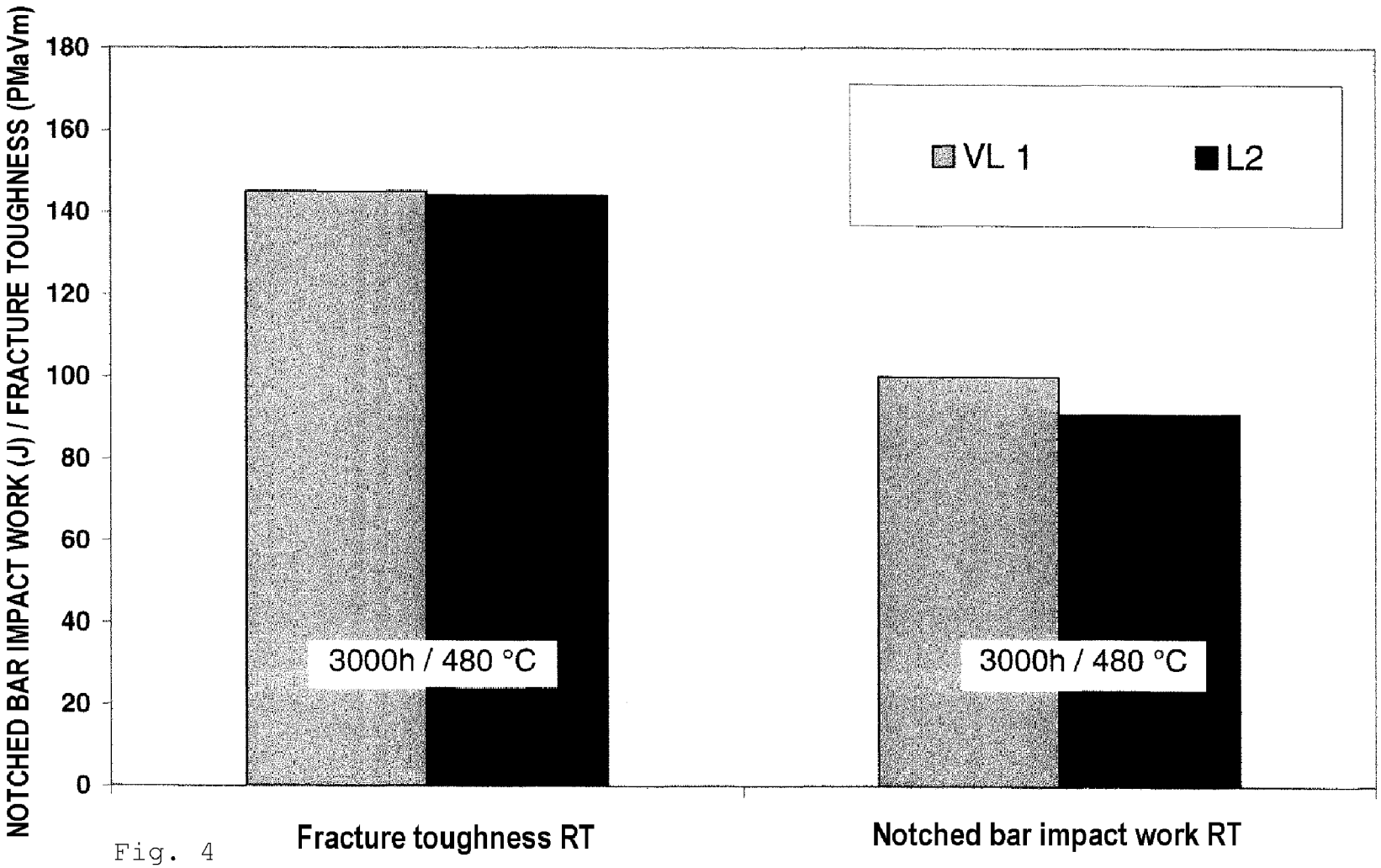
FIG. 4 shows a graphical illustration analogous to FIG. 3, but in which the samples have additionally been age-hardened for 3000 hours at 480° C. after heat treatment.

FIG. 4 shows the influence of long-term age hardening at a temperature of 480° C. This figure shows the fracture toughnesses and impact energies at room temperature for the two alloys L2 and VL1 investigated, after age hardening for 3000 hours at 480° C. In spite of the markedly better creep properties at high temperatures (markedly better strength values), the toughness properties of the alloy L2 according to the invention are virtually just as good as those of VL1.

This very good property combination (very high creep resistance at temperatures of 450° C. and considerably above, good toughness properties after long-term age hardening at high temperatures), is achieved, as compared with the prior art, by the combination of the alloying elements B, Ta, La, and Pd in the ranges specified.

In summary, it must be said that, on the one hand, alloys embodying principles of the present invention can be distinguished by a very high creep resistance at temperatures of 450° C., preferably 550° C., and above and are consequently superior to the conventional 12% Cr steels. This is attributable predominantly to the influence of boron, tantalum, and palladium which are added for alloying in the specified range. Boron, tantalum, and palladium stabilize the $M_{23}C_6$ precipitations which play a substantial consolidating part during creeping, Pd additionally forming a stable intermettalic phase with the iron, this also contributing to increasing the creep resistance. In addition, the dislocation density up to fracture is maintained and therefore the creep strength of the steel is improved. Ta and Pd have a similar effect on the increase of the creep strength. On the other hand, the alloy according to the invention has improved resistance to embrittlement during long-term aging and comparatively high toughness. This is attributable to the addition of lanthanum in the specified range, because this results in both the grain size being reduced and stable lanthanum sulfides $La_2S_3$ being formed.

Alloys according to principles of the present invention can therefore advantageously be used particularly for rotors in gas and steam turbines which are exposed to high inlet temperatures of above 550° C.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A creep-resistant steel consisting of (values in % by weight): 0.08 to 0.16 C, 9.0 to 12.0 Cr, 0.1 to 0.5 Mn, 2.3 to 3 Ni, 1.5 to 2.0 Mo, 0.1 to 0.4 V, 0.01 to 0.06 Nb, 0.02 to 0.08 N, 0.001 to 2 Ta, 0.001 to 0.5 La, 0.001 Pd, 0.004 to 0.012 B, maximum 0.005 P, maximum 0.005 S, maximum 0.05 Si, maximum 0.005 Sn, the remainder iron and unavoidable impurities.

2. The creep-resistant steel as claimed in claim 1, wherein the Ni content is 2.3 to 2.8%.

3. The creep-resistant steel as claimed in claim 2, wherein the Ni content is 2.5%.

4. The creep-resistant steel as claimed in claim 1, wherein the Cr content is 10 to 12%.

5. The creep-resistant steel as claimed in claim 3, wherein the Cr content is 10.5 to 11.5%.

6. The creep-resistant steel as claimed in claim 1, wherein the C content is 0.10 to 0.14%.

7. The creep-resistant steel as claimed in claim 6, wherein the C content is 0.12%.

8. The creep-resistant steel as claimed in claim 1, wherein the Mn content is 0.10 to 0.25%.

9. The creep-resistant steel as claimed in claim 8, wherein the Mn content is 0.20%.

10. The creep-resistant steel as claimed in claim 1, wherein the Mo content is 1.6 to 1.8%.

11. The creep-resistant steel as claimed in claim 10, wherein the Mo content is 1.7%.

12. The creep-resistant steel as claimed in claim 1, wherein the V content is 0.2 to 0.3%.

13. The creep-resistant steel as claimed in claim 12, wherein the V content is 0.25%.

14. The creep-resistant steel as claimed in claim 1, wherein the Nb content is 0.02 to 0.04%.

15. The creep-resistant steel as claimed in claim 14, wherein the Nb content is 0.03%.

16. The creep-resistant steel as claimed in claim 1, wherein the N content is 0.025 to 0.055%.

17. The creep-resistant steel as claimed in claim 16, wherein the N content is 0.04%.

18. The creep-resistant steel as claimed in claim 1, wherein the B content is 0.005 to 0.012%.

19. The creep-resistant steel as claimed in claim 18, wherein the B content is 0.007%.

20. The creep-resistant steel as claimed in claim 1, wherein the Ta content is 0.005 to 0.1%.

21. The creep-resistant steel as claimed in claim 20, wherein the Ta content is 0.01%.

22. The creep-resistant steel as claimed in claim 1, wherein the La content is 0.01 to 0.1%.

23. The creep-resistant steel as claimed in claim 22, wherein the La content is 0.05%.

24. A thermal turbomachine rotor formed of the creep-resistant steel as claimed in claim 1.

* * * * *